US009494013B2

(12) United States Patent
Ringgenberg et al.

(10) Patent No.: US 9,494,013 B2
(45) Date of Patent: Nov. 15, 2016

(54) CONFIGURABLE AND EXPANDABLE FLUID METERING SYSTEM

(71) Applicant: Halliburton Energy Services, Inc., Houston, TX (US)

(72) Inventors: Paul David Ringgenberg, Frisco, TX (US); Kevin Michael Renkes, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/349,618

(22) PCT Filed: Mar. 8, 2013

(86) PCT No.: PCT/US2013/029988

§ 371 (c)(1),
(2) Date: Apr. 3, 2014

(87) PCT Pub. No.: WO2014/137358

PCT Pub. Date: Sep. 12, 2014

(65) Prior Publication Data

US 2015/0361762 A1 Dec. 17, 2015

(51) Int. Cl.

| | |
|---|---|
| ***F17D 1/00*** | (2006.01) |
| ***E21B 34/06*** | (2006.01) |
| ***E21B 43/12*** | (2006.01) |
| ***E21B 34/10*** | (2006.01) |
| ***E21B 49/08*** | (2006.01) |

(52) U.S. Cl.

CPC ..... *E21B 34/06* (2013.01); *E21B 34/10* (2013.01); *E21B 34/102* (2013.01); *E21B 43/12* (2013.01); *E21B 49/08* (2013.01)

(58) Field of Classification Search

CPC .. E21B 2034/002; E21B 21/08; E21B 21/12; E21B 21/103; E21B 49/001; E21B 34/06

USPC ..... 137/599.11, 601.18; 73/152.23, 152.28; 166/205, 235, 242.1, 316, 373

See application file for complete search history.

(56) References Cited

U.S. PATENT DOCUMENTS

| | | | | |
|---|---|---|---|---|
| 4,624,317 | A * | 11/1986 | Barrington | E21B 34/06 166/162 |
| 4,836,305 | A * | 6/1989 | Curlett | E21B 17/003 175/215 |
| 5,050,681 | A * | 9/1991 | Skinner | E21B 34/066 166/319 |
| 5,193,621 | A * | 3/1993 | Manke | E21B 34/125 166/145 |
| 5,335,731 | A * | 8/1994 | Ringgenberg | E21B 23/006 166/264 |
| 5,518,073 | A * | 5/1996 | Manke | E21B 23/006 166/240 |
| 5,558,162 | A | 9/1996 | Manke et al. | |
| 5,992,520 | A | 11/1999 | Schultz et al. | |
| 2002/0014338 | A1 | 2/2002 | Purkis et al. | |
| 2007/0193377 | A1 * | 8/2007 | Irani | E21B 49/081 73/864.62 |
| 2009/0250224 | A1 | 10/2009 | Wright et al. | |
| 2009/0293606 | A1 | 12/2009 | Irani et al. | |

* cited by examiner

*Primary Examiner* — John Fox
*Assistant Examiner* — Reinaldo Sanchez-Medina

(57) ABSTRACT

A configurable metering cartridge includes a body having a tortuous pathway between an inlet and an outlet, and the tortuous pathway includes a plurality of restrictors. At least one valve is in fluid communication with the tortuous pathway and is selectively positionable to allow or prevent fluid flow through one or more of the plurality of restrictors.

12 Claims, 9 Drawing Sheets

CONFIGURABLE AND EXPANDABLE FLUID METERING SYSTEM

CROSS REFERENCE TO RELATED APPLICATIONS

This application claims priority to PCT Patent Application Number PCT/US13/29988 filed on Mar. 8, 2013 entitled CONFIGURABLE AND EXPANDABLE FLUID METERING SYSTEM, the entire teachings of which are incorporated herein.

BACKGROUND

1. Field of the Invention

The present disclosure relates generally to the recovery of subterranean deposits and more specifically to methods and systems for metering fluid flow within a well.

2. Description of Related Art

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is attached to a drill string that may be rotated to drive the drill bit and within which drilling fluid, referred to as "drilling mud" or "mud", may be delivered downhole. The drilling mud is used to cool and lubricate the drill bit and downhole equipment and is also used to transport any rock fragments or other cuttings to the surface of the well.

As wells are established it is often useful to obtain information about the well and the geological formations through which the well passes. Information gathering may be performed using tools that are delivered downhole by wireline, tools coupled to or integrated into the drill string, or tools delivered on other types of testing strings. Tester valves may be deployed downhole to allow selective control of the flow of formation fluids into a tubing string. Due to the variation in pressures and temperatures associated with downhole fluids, hydraulic and pneumatic mechanisms incorporated into these tester valves may become less reliable and functional when subjected to these downhole conditions. While fluid flow restrictors have occasionally offered a solution to controlling the flow of fluids in downhole devices such as tester valves, the fluid flow restrictors themselves have not been easily adjustable or configurable in an operational setting.

SUMMARY

The problems presented by existing systems and methods for metering fluid flow are solved by the systems and methods of the illustrative embodiments described herein. In one embodiment, a configurable metering cartridge includes a body having an inlet and an outlet and a plurality of passageways disposed in the body. The plurality of passageway is arranged such that a continuous path of fluid communication is provided between the inlet and the outlet. The configurable metering cartridge further includes a restrictor positioned in a first of the plurality of passageways and a valve positioned in fluid communication with the first of the plurality of passageways and a second of the plurality of passageways. The valve is selectively positionable in at least two positions. The valve in a first of the positions requires fluid flowing from the first passageway to the second passageway to pass through the restrictor. The valve in a second of the positions allows fluid flowing from the first passageway to the second passageway to bypass the restrictor.

In another embodiment, a configurable metering cartridge includes a body having a tortuous pathway between an inlet and an outlet. The tortuous pathway includes a plurality of restrictors. The metering cartridge further includes at least one valve in fluid communication with the tortuous pathway and selectively positionable to allow or prevent fluid flow through one or more of the plurality of restrictors.

In yet another embodiment, a method for metering fluid flow includes providing a flow path through which fluid may flow between an inlet and an outlet. A plurality of restrictor devices are positioned in the flow path. For each of the plurality of restrictor devices, the fluid in the flow path is independently and selectively directed such that, depending upon said selection, fluid either bypasses the restrictor device or flows through the restrictor device.

In still another embodiment, a downhole tester valve for controlling a formation fluid includes a valve member selectively positionable in an open position or a closed position to allow or prevent fluid communication through a passage of the downhole tester valve. An actuation arm is operably associated with the valve member to position the valve member in the open position or the closed position. A gas-filled chamber includes a pressurized gas exerting a biasing force on the actuation member to bias the valve member toward the closed position. A liquid chamber is separated from the gas-filled chamber by a gas-fluid balancing seal, the liquid chamber having a liquid capable of exerting an equalizing force on the gas-fluid balancing seal to compress the gas in the gas-filled chamber such that a pressure of the gas in the chamber is approximately equal to a pressure of the liquid in the liquid chamber. A configurable metering device is provided and includes an inlet and an outlet and a pathway between the inlet and the outlet. The outlet of the configurable metering device is in fluid communication with the liquid chamber, and the configurable metering device is capable of restricting liquid flow into or out of the liquid chamber. The configurable metering device further includes a plurality of restrictors positioned within the pathway and at least one valve in fluid communication with the pathway and selectively positionable to allow or prevent liquid flow through one or more of the plurality of restrictors.

Other objects, features, and advantages of the invention will become apparent with reference to the drawings, detailed description, and claims that follow.

DETAILED DESCRIPTION OF ILLUSTRATIVE EMBODIMENTS

Figure 1:
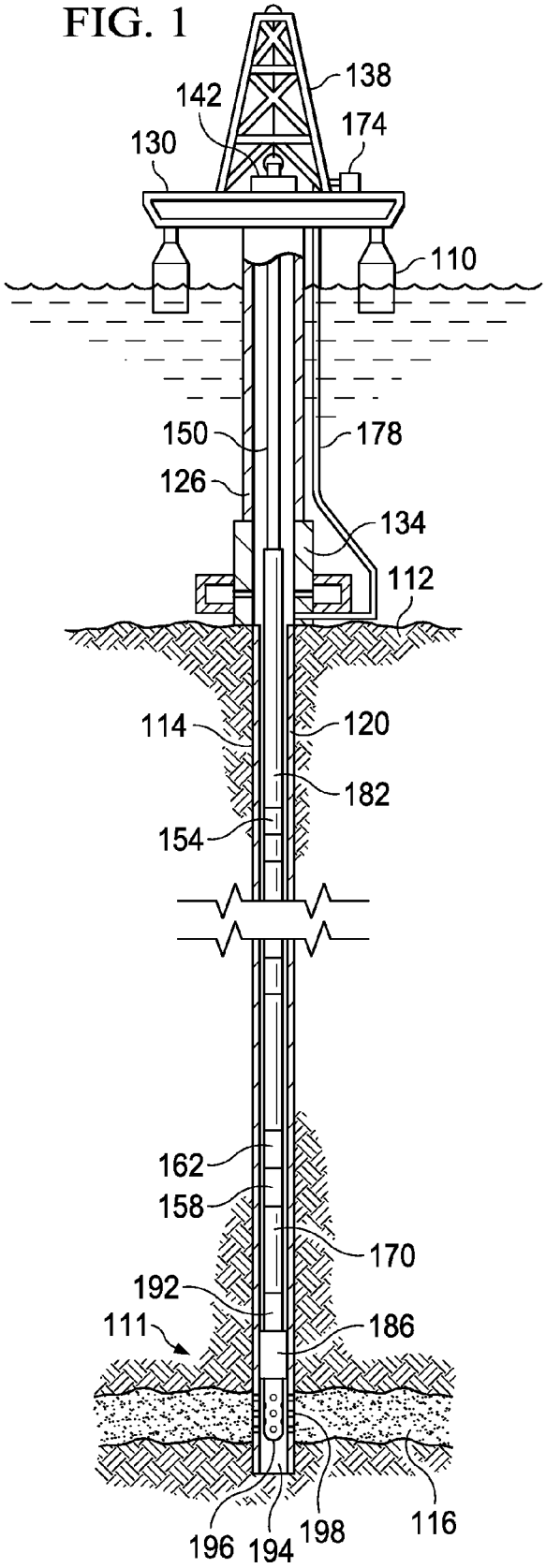
FIG. 1 illustrates a schematic depiction of a well in which a tester valve and a configurable metering cartridge according to an illustrative embodiment are deployed.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The systems and methods described herein provide metering of fluids used in wells to recover subterranean deposits. The metering systems and methods provide selective configuration and control of fluid flow rate or pressure drop. Such metering systems and methods are beneficial in the operation of downhole valves used to sample formation fluids, but may be equally or more beneficial in other downhole or surface-based devices and operations. In some of the embodiments described herein, the configurable nature of the metering systems and methods is provided by a cartridge-type body that allows the interchangeability of multiple fluid restrictors. By selectively routing fluid through one or more of the fluid restrictors in a cartridge-like metering body, extreme flexibility is provided in the ability to adjust the overall amount of fluid restriction provided by the metering body. Adjustability of the flow path of fluid within the metering body permits the selection or exclusion of specific restriction devices within the metering body, which provides further configurability.

Some of the illustrative embodiments described in the following disclosure, such as the tester valve in which a metering cartridge resides, may be used to evaluate a formation through which a well passes. Tester valves, or other downhole devices that incorporate the metering devices described herein may be used with any of the various techniques employed for evaluating formations including, without limitation, wireline formation testing (WFT), measurement while drilling (MWD), and logging while drilling (LWD). The various valves and tools described herein may be delivered downhole as part of a wireline-delivered downhole assembly or as a part of a drill string.

As used herein, the phrases "fluidly coupled," "fluidly connected," and "in fluid communication" refer to a form of coupling, connection, or communication related to fluids, and the corresponding flows or pressures associated with these fluids. Reference to a fluid coupling, connection, or communication between two components describes components that are associated in such a way that a fluid can flow between or among the components.

Referring to FIG. 1, a floating platform 110 is positioned over a submerged oil or gas well 111 located in the sea floor 112 having a bore hole 114 which extends from the sea floor 112 to a submerged formation 116 to be tested. The bore hole 114 may be lined by a casing 120 cemented into place. A subsea conduit 126 extends from a deck 130 of the floating platform 110 into a wellhead installation 134. The floating platform 110 further includes a derrick 138 and a hoisting apparatus 142 for raising and lowering tools to drill, test, and complete the oil or gas well 111.

A testing string 150 is lowered into the bore hole 114 of the oil or gas well 111. The testing string 150 includes such tools as a slip joint 154 to compensate for the wave action of the floating platform 110 as the testing string 150 is lowered into place, a tester valve 158 and a circulation valve 162.

The slip joint 154 may be similar to that described in U.S. Pat. No. 3,354,950 to Hyde. This patent and any other patents, patent applications, or other publications referenced herein are incorporated by reference to the maximum extent allowable by law. The circulation valve 162 may be an annulus pressure responsive type and may be similar to that described in U.S. Pat. No. 3,850,250 to Holden et al, or may be a combination circulation valve and sample entrapment mechanism similar to those disclosed in U.S. Pat. No. 4,063,593 to Jessup or U.S. Pat. No. 4,064,937 to Barrington. The circulation valve 162 may also be the recloseable type as described in U.S. Pat. No. 4,113,012 to Evans et al.

A check valve assembly 170 as described in U.S. Pat. application No. 128,324 filed Mar. 7, 1980 which is annulus pressure responsive may be located in the testing string below the tester valve 158 of the present invention.

The tester valve 158, circulation valve 162 and check valve assembly 170 may be operated by fluid annulus pressure exerted by a pump 174 on the deck 130 of the floating platform 110. Pressure changes are transmitted by a pipe 178 to a well annulus 182 between the casing 120 and the testing string 150. Well annulus pressure is isolated from the formation 116 to be tested by a packer 186 set in the well casing 120 just above the formation 116. The packer 186 may be any suitable packer, such as for example a Baker Oil Tool™ Model D packer, an Otis™ type W packer or the Halliburton Services EZ Drill® SV packer.

The testing string 150 includes a tubing seal assembly 192 at the lower end of the testing string which stabs through a passageway through the production packer 186 for forming a seal isolating the well annulus 182 above the packer 186 from an interior bore portion 194 of the well immediately adjacent the formation 116 and below the packer 186.

A perforated tail piece 196 or other production tube is located at the bottom end of the seal assembly 192 to allow formation fluids to flow from the formation 116 into the flow passage of the testing string 150. Formation fluid is admitted into interior bore portion 194 through perforations 198 provided in the casing 120 adjacent formation 116.

A formation test controlling the flow of fluid from the formation 116 through the flow channel in the testing string 150 by applying and releasing fluid annulus pressure to the well annulus 182 by pump 174 to operate tester valve 158, circulation valve assembly 162 and check valve assembly 170 and measuring of the pressure build-up curves and fluid temperature curves with appropriate pressure and temperature sensors in the testing string 150 is described in more detail in the aforementioned patents and patent application, all of which are incorporated herein by reference.

While the well 111 is illustrated as being an offshore well in FIG. 1, the systems and devices described herein will function equally well in an on-shore well.

Figure 2:
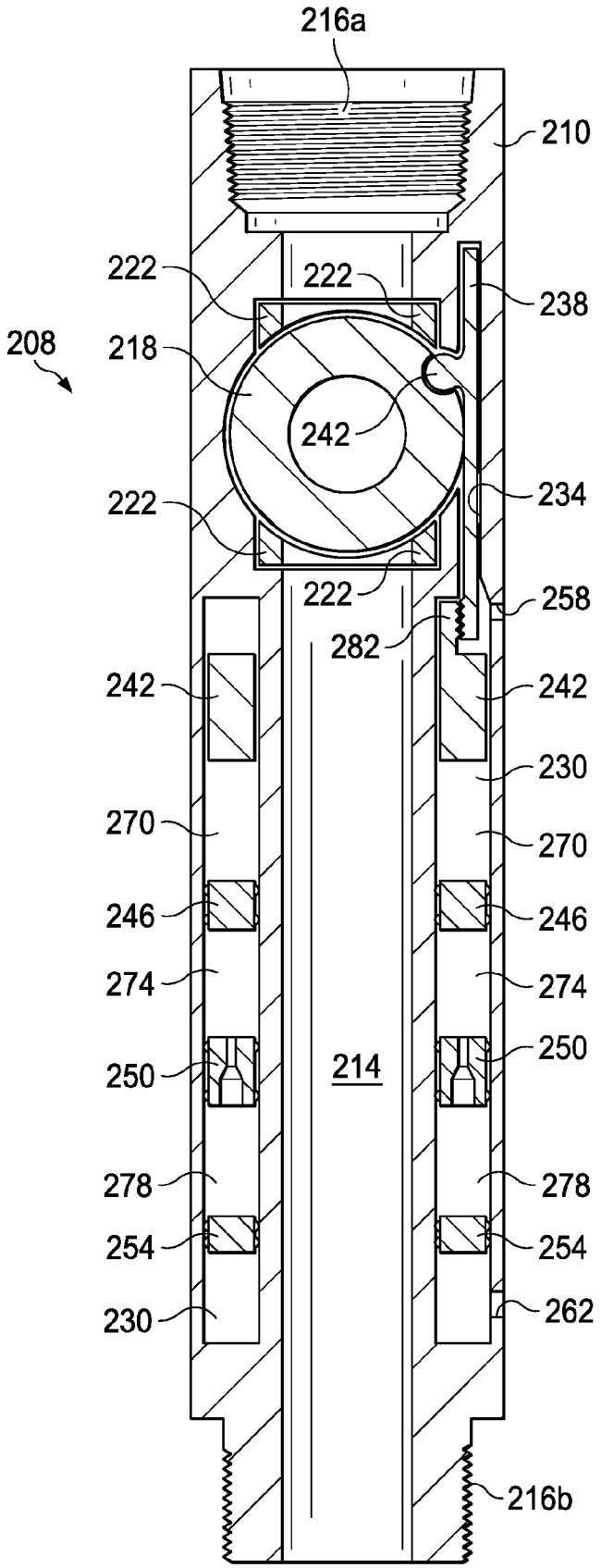
FIG. 2 illustrates cross-sectional front view of the tester valve of FIG. 1.
Figure 3:
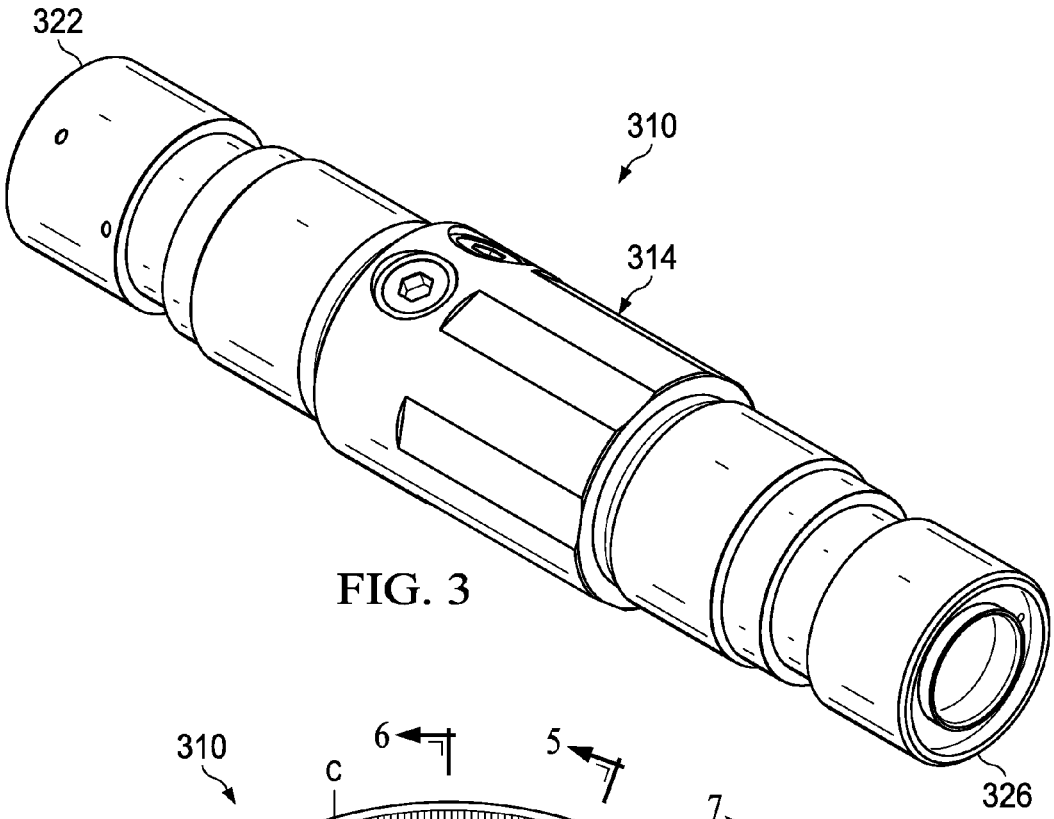
FIG. 3 illustrates an isometric front view of a configurable metering cartridge according to an illustrative embodiment.

Referring to FIG. 2, a tester valve 208 according to an illustrative embodiment is similar to tester valve 158 and is similar in function to the tester valve described in U.S. Pat. No. 4,422,506, which is hereby incorporated by reference. Tester valve 208 is depicted schematically in FIG. 2 and includes a valve housing 210 that is substantially cylindrical in shape and includes a central passage 214 extending the length of the valve housing 210. The valve housing 210 includes threaded connection components 216*a*, 216*b* to allow connection of the tester valve 208 within a test string or to other downhole devices. A valve member 218 is rotatably positioned within the valve housing 210 and is axially anchored within the valve housing 210 by ring-shaped valve seats 222 positioned above and below the valve member 218. The valve housing 210 includes an annular chamber 230 and an actuation sleeve 234 extending from the annular chamber. The actuation sleeve 234 receives an actuation arm 238 having a spherically shaped lug 242 that is received by a complimentary recess on the valve member 218. Through movement of the actuation arm 238 in a direction parallel to the longitudinal axis of the valve housing 210, the valve member 218 is positioned in a closed position (shown in FIG. 2) that prevents fluid flow past the valve member 218 or in an open position that allows fluid flow past the valve member 218.

Positioned within the annular chamber 230 are a power mandrel 242, a gas-fluid balancing seal 246, a metering cartridge 250, and a fluid balancing piston 254. An upper port 258 provides fluid communication between an exterior of the valve housing 210 and the annular chamber 230 above the power mandrel 242. A lower port 262 provides fluid communication between the exterior of the valve housing 210 and the annular chamber 230 beneath the fluid balancing piston 254. Between the power mandrel 242 and the gas-fluid balancing seal 246 is a gas-filled region 270 of the annular chamber 230. Seals on both the power mandrel and the gas-fluid balancing seal 246 prevent leakage of gas from the gas-filled region 270. The gas that is provided in the gas-filled region 270 may be an inert gas, and in one embodiment, the gas may be nitrogen. Between the gas-fluid balancing seal 246 and the fluid balancing piston 254 are an upper liquid region 274 and a lower liquid region 278, the two regions separated by the metering cartridge 250. Each of the upper liquid region 274 and the lower liquid regions 278 are filled with a liquid, which in one embodiment is an oil.

The power mandrel 242 is ring-shaped and is positioned in annular chamber 230 such that it is capable of axial movement. An extension member 282 extends from the power mandrel 242 and is connected to the actuation arm 238 so that the actuation arm 238 moves along with the power mandrel 242. The nitrogen or other gas in the gas-filled region 270 serves dual purposes. First, the gas is capable of cushioning the movement of the power mandrel 242, and thus the valve member 218 when an operator decides to move the valve member 218 to the open position. Second, and as explained in more detail below, the pressurized gas within the gas-filled region 270 assists in moving the valve member 218 to a closed position when directed by the operator. Prior to deploying the tester valve 208 downhole, the gas-filled region 270 is filled with gas until a desired pressure is reached. Since low temperatures may be encountered downhole, the pressure of gas within the gas-filled region 270 may decrease if subjected to severe temperature drops. Since the operation of the valve member 218 depends greatly on the pressure of gas within the gas-filled region 270, it is important that the pressure of gas remain relatively close to but slightly less than the pressure of the fluid surrounding the tester valve 218, i.e. the annulus pressure. This pressure compensation is made possible by the presence of the lower port 262, the fluid balancing piston 254, the upper and lower liquid regions 274, 278, the metering cartridge 250, and the gas-fluid balancing seal 246. The pressure of fluid surrounding the tester valve 208 is communicated through the lower port 262 into the area of the annular chamber 230 beneath the fluid balancing piston 254. The fluid balancing piston 254 moves axially in response to the pressure (upward movement if higher pressure is encountered, downward movement if lower pressure is encountered). The movement of the fluid balancing piston 254 results in a pressure change of the liquid in the lower liquid region 278, and in the scenario where the pressure of the liquid in the lower liquid region 278 increases, liquid is compelled to move through the metering cartridge 250 toward the upper liquid region 274 until equilibrium is reached. The metering cartridge 250, as explained in more detail below, includes one or more restrictor devices that meter flow through the metering cartridge 250. As the pressure of liquid in the upper liquid region 274 rises, this pressure is transmitted to the gas-filled region 270 by the movement of gas-fluid balancing seal 246.

To open the valve member 218, the annulus pressure surrounding the tester valve 208 is increased, which is communicated through upper port 258 and exerts a downward force on the power mandrel 242. The power mandrel 242 therefore moves axially downward, pulling the actuation arm 238, which positions the valve member 218 in the open position. Since the pressure of gas in the gas-filled region 270 closely approximates the annulus pressure surrounding the tester valve 208, the gas-filled region 270 is capable of cushioning the downward movement of the power mandrel 242 and thus the opening of the valve member 218.

The force imparted to the power mandrel 242 is still able to overcome any force exerted by the gas-filled region 270 since the increases to the annulus pressure are communicated through the lower port 262 and are modulated by the presence and flow metering capabilities of the metering cartridge 250. It should be noted, however, that the increase in annulus pressure, which is used to open the valve member 218, is transmitted as a corresponding pressure increase to the gas-filled region 270 through the lower port 262 and the components previously described. Due to the presence of the metering cartridge 250, the subsequent increase in pressure in the gas-filled region 270 is not as great as the annulus pressure increase, thereby resulting in the imbalance in forces across the power mandrel 242 that allow the power mandrel to move downward.

When it is desired to close the valve member 218, the annulus pressure surrounding the tester valve 208 is decreased. Although the pressure decrease is communicated through both the upper and lower ports 258, 262, the metering of fluid flow through the metering valve 250 creates a lag in the time it takes for the gas-filled region to decrease in pressure. Again, this creates an imbalance in forces across the power mandrel 242, with the pressure in the gas-filled region 270 beneath the power mandrel 242 begin greater than pressure in the annular chamber 230 above the power mandrel. This pressure differential moves the power mandrel 242 and actuation arm 238 upward, which returns the valve member 218 to the closed position.

Referring to FIGS. 3-11, a metering cartridge 310 similar in function to metering cartridge 250 of FIG. 2 includes a body 314 that may be substantially elongate and cylindrical in shape. The metering cartridge 310 may be machined, cast or otherwise formed from a metal or other suitable material such as steel. A central passage 318 is provided in the body 314 and extends from a first end 322 of the body 314 to a second end 326 of the body 314. The body 314 includes a wall 330 that surrounds the central passage 318 and may be of varying thickness along the length of body 314 (see FIG. 5).

Figure 4:
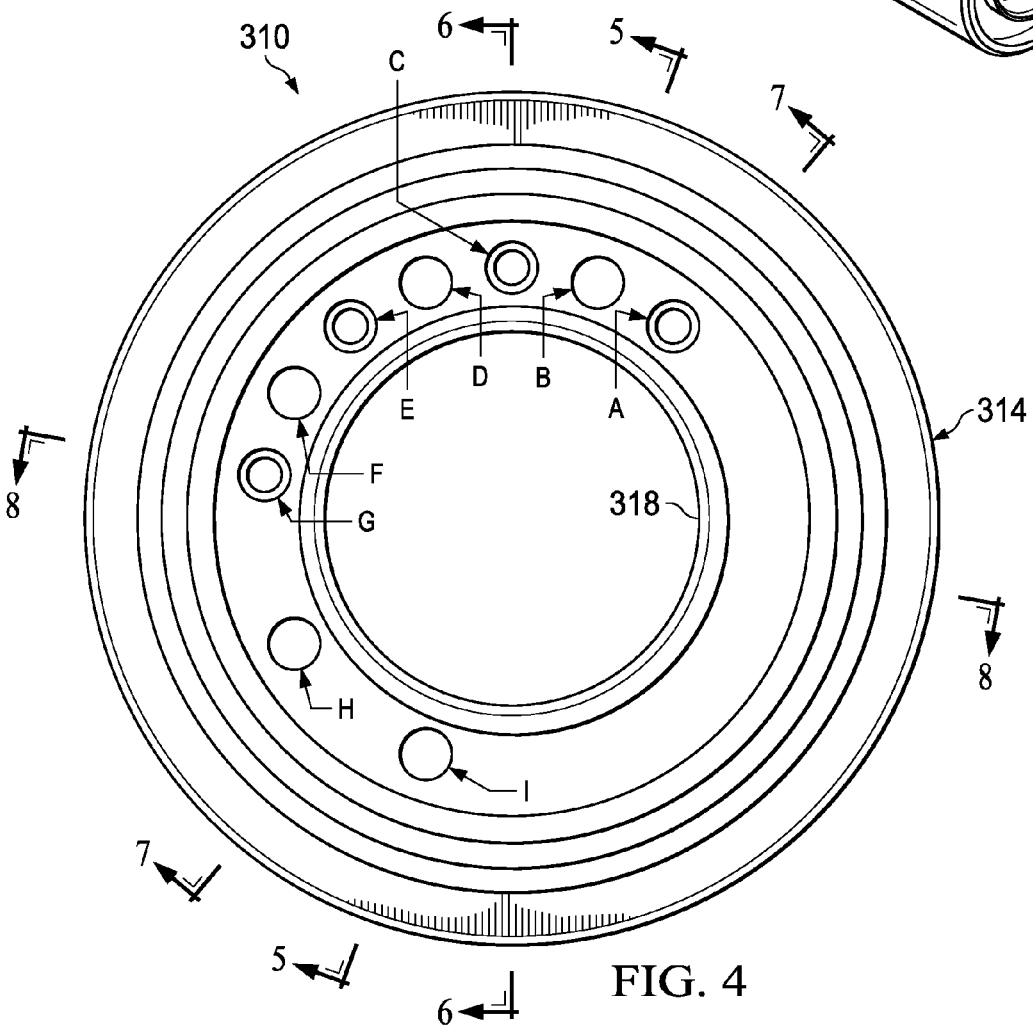
FIG. 4 illustrates a left side view of the configurable metering cartridge of FIG. 3.

Referring more specifically to FIG. 4, the metering cartridge 310 may include a plurality of passageways disposed in the body 314. In the embodiment illustrated in FIGS. 3-11, each of the passageways are individually identified by reference letters A, B, C, D, E, F, G, H, and I. While nine passageways are provided in this particular embodiment, the number of passageways included in any particular metering cartridge may vary depending at least in part on the level of configurability desired for metering flow through the metering cartridge. In one embodiment, each passageway A-I is drilled or otherwise formed in the wall 330 of the body 314, and the length of each passageway A-I may vary depending on the overall configuration of the metering cartridge 310.

Figure 6:
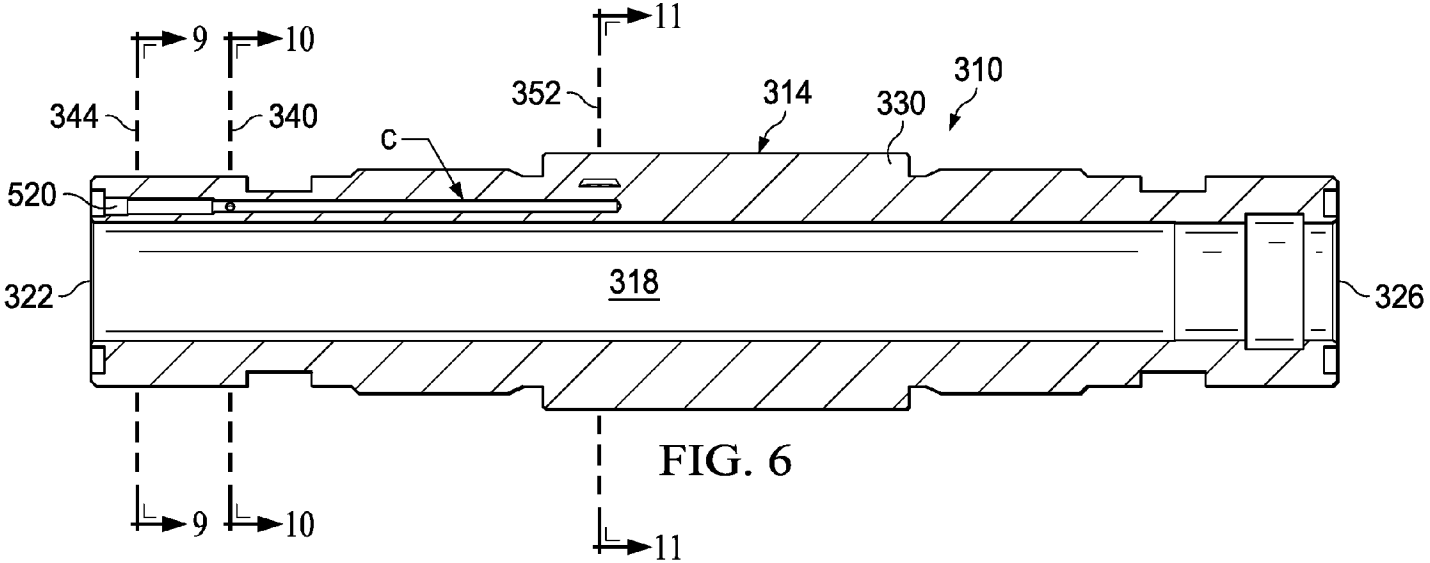
FIG. 6 illustrates a cross-sectional view of the configurable metering cartridge of FIG. 4 taken at 6-6.
Figure 7:
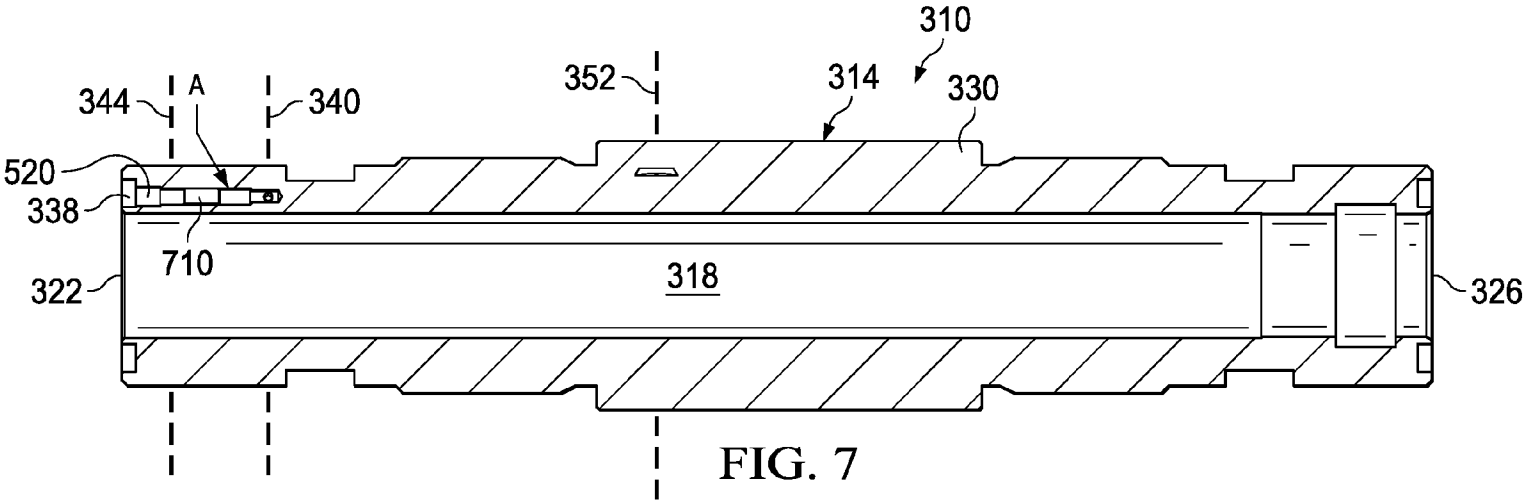
FIG. 7 illustrates a cross-sectional view of the configurable metering cartridge of FIG. 4 taken at 7-7.

Referring more specifically to FIGS. 4 and 7, in some embodiments, passageway A includes an inlet 338 to the metering cartridge 310 at the first end 322 of the body 314. Passageway A extends from the first end 322 of the body 314 to an intersection plane 340, which corresponds to the cross-section line 10-10 illustrated in FIG. 6.

Figure 5:
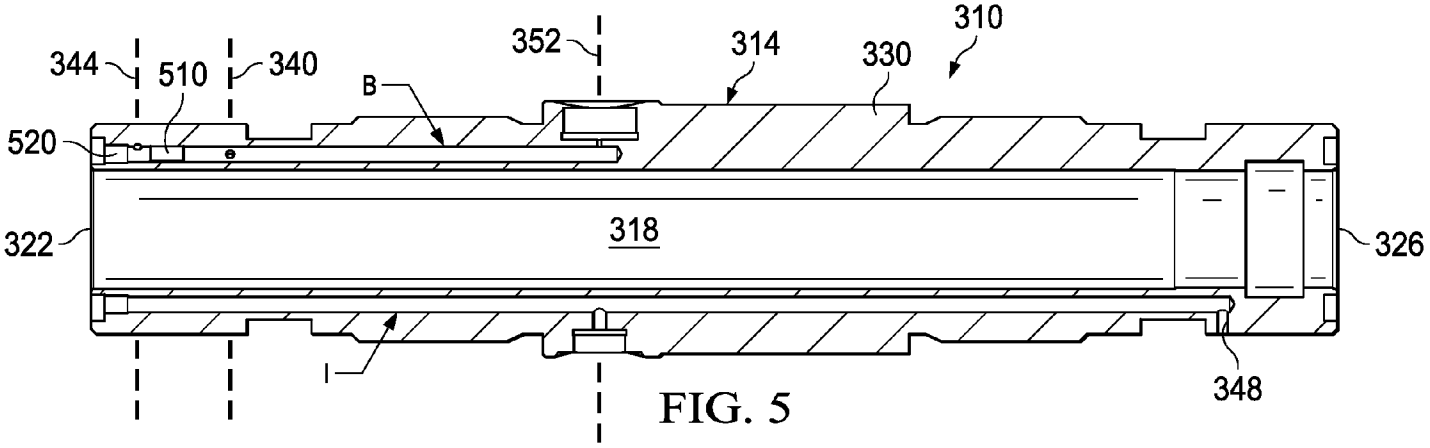
FIG. 5 illustrates a cross-sectional view of the configurable metering cartridge of FIG. 4 taken at 5-5.

Referring more specifically to FIGS. 4 and 5, passageway B extends from the first end 322 of the body 314 to an intersection plane 352, which corresponds to the cross-section line 11-11 illustrated in FIG. 6. Passageway I (FIG. 5) and passageway H (not illustrated in cross-section) both extend from the first end 322 of the body 314 toward the second end 326 but do not penetrate the second end 326 of the body 314. A pair of lateral ports 348 (illustrated in FIG. 5 for passageway I and in FIG. 10 for passageway H) are provided, each lateral port 348 extending from an outer surface of the body 314 and intersecting either the passageway I or the passageway H at a substantially perpendicular angle. Together the lateral ports 348 and the passageways I and H function as fill or drain lines such that a chamber or other container in fluid communication with the metering cartridge 310 may be filled or drained of fluid.

Referring to FIGS. 4 and 6, passageway C is illustrated, and in some embodiments the length and positioning of passageway C is similar to that of passageways D, E, and F. These passageways extend from the first end 322 of the body 314 to the intersection plane 352, which also corresponds to the cross-section line 11-11.

Figure 8:
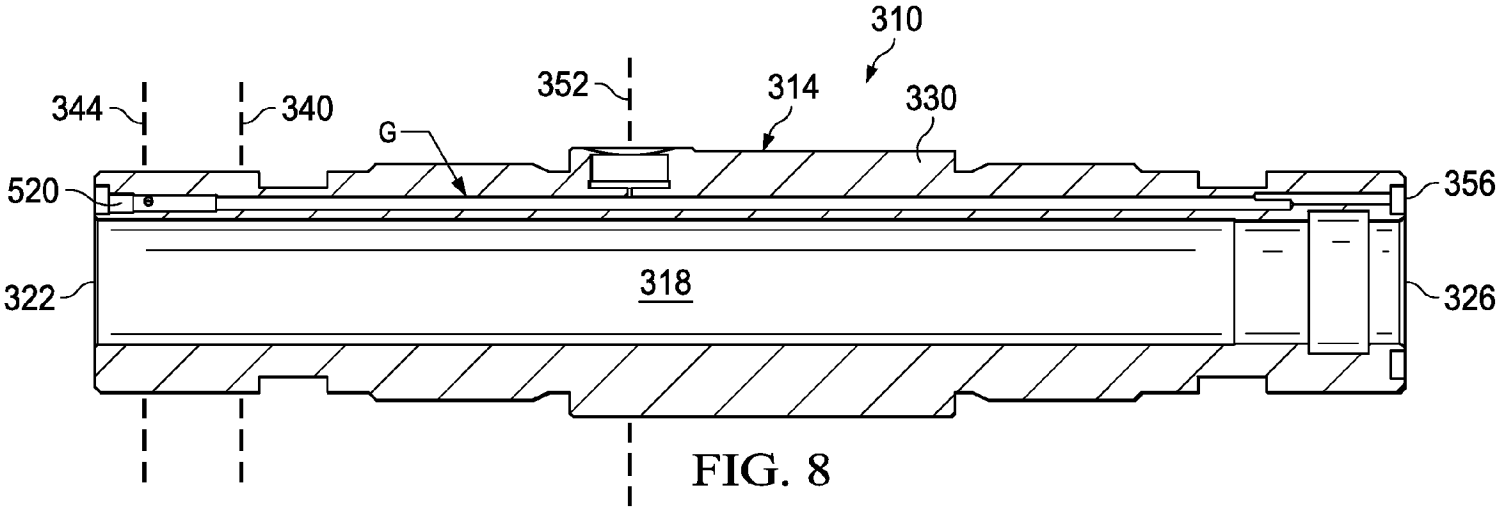
FIG. 8 illustrates a cross-sectional view of the configurable metering cartridge of FIG. 4 taken at 8-8.

Referring more specifically to FIGS. 4 and 8, passageway G extends from the first end 322 of the body 314 to the second end 326 of the body 314. Passageway G includes an outlet 356 to the metering cartridge 310 at the second end 326 of the body 314.

In the embodiments illustrated in FIGS. 3-11, the plurality of passageways A-I are arranged in the body 314 such that the passageways are substantially parallel to one another. Since the metering cartridge 310 is constructed by drilling or otherwise forming the passageways from the first end 322 of the body 314, each of the passageways B-I includes a cap region 520 that may be provided with threads or other attachment devices such that a primary plug (not shown) may be received by the cap region 520. Alternatively, the primary plug may be permanently installed in the cap region 520 by welding, adhesive, or another suitable attachment method. The installation of the primary plug in each passageway B-I prevents fluid traveling within the passageway from leaking from the metering cartridge 310.

At each of the intersection planes 340, 344, 352, lateral passageways are provided such that some of the passageways A-I are fluidly connected to one another. The lateral passageways, described in more detail below, coupled with the passageways A-I together create a continuous and tortuous pathway of fluid communication between the inlet 338 and the outlet 356 of the metering cartridge.

Figure 9:
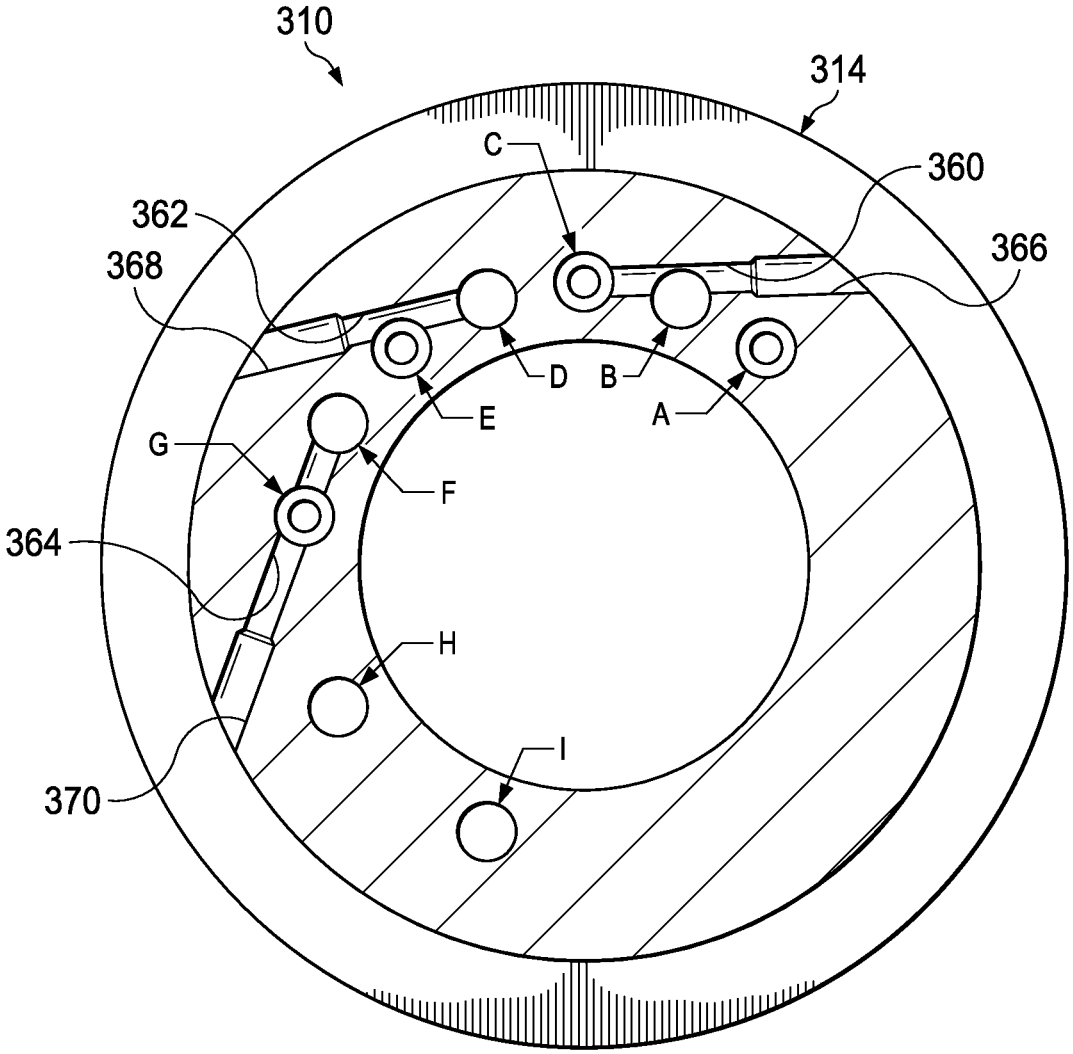
FIG. 9 illustrates a cross-sectional view of the configurable metering cartridge of FIG. 6 taken at 9-9.

A cross-section of the intersection plane 344 is more clearly illustrated in FIG. 9. In some embodiments, lateral main channels 360, 362, 364 may be positioned in the body 314 such that a longitudinal axis associated with each lateral main channel is contained within or is parallel to the intersection plane 344. Lateral main channel 360 intersects and fluidly connects passageway B and passageway C. Lateral main channel 362 intersects and fluidly connects passageway D and passageway E. Lateral main channel 364 intersects and fluidly connects passageway F and passageway G. Each of the lateral main channels 360, 362, 364 extends from an exterior surface of the body 314 to intersect the applicable passageways. A cap region 366, 368, 370 of each lateral main channel 360, 362, 364 may be provided with threads or other attachment devices such that a lateral main plug (not shown) may be received by each cap region 366, 368, 370. Alternatively, the lateral main plug may be permanently installed in the cap region by welding, adhesive, or another suitable attachment method. The installation of the lateral main plug in each lateral main channel 360, 362, 364 provides sealing of the lateral main channel 360, 362, 364 such that fluid traveling through the lateral main channel 360, 362, 364 is directed between the applicable passageways B-G and is not permitted to leak from the metering cartridge 310.

Figure 10:
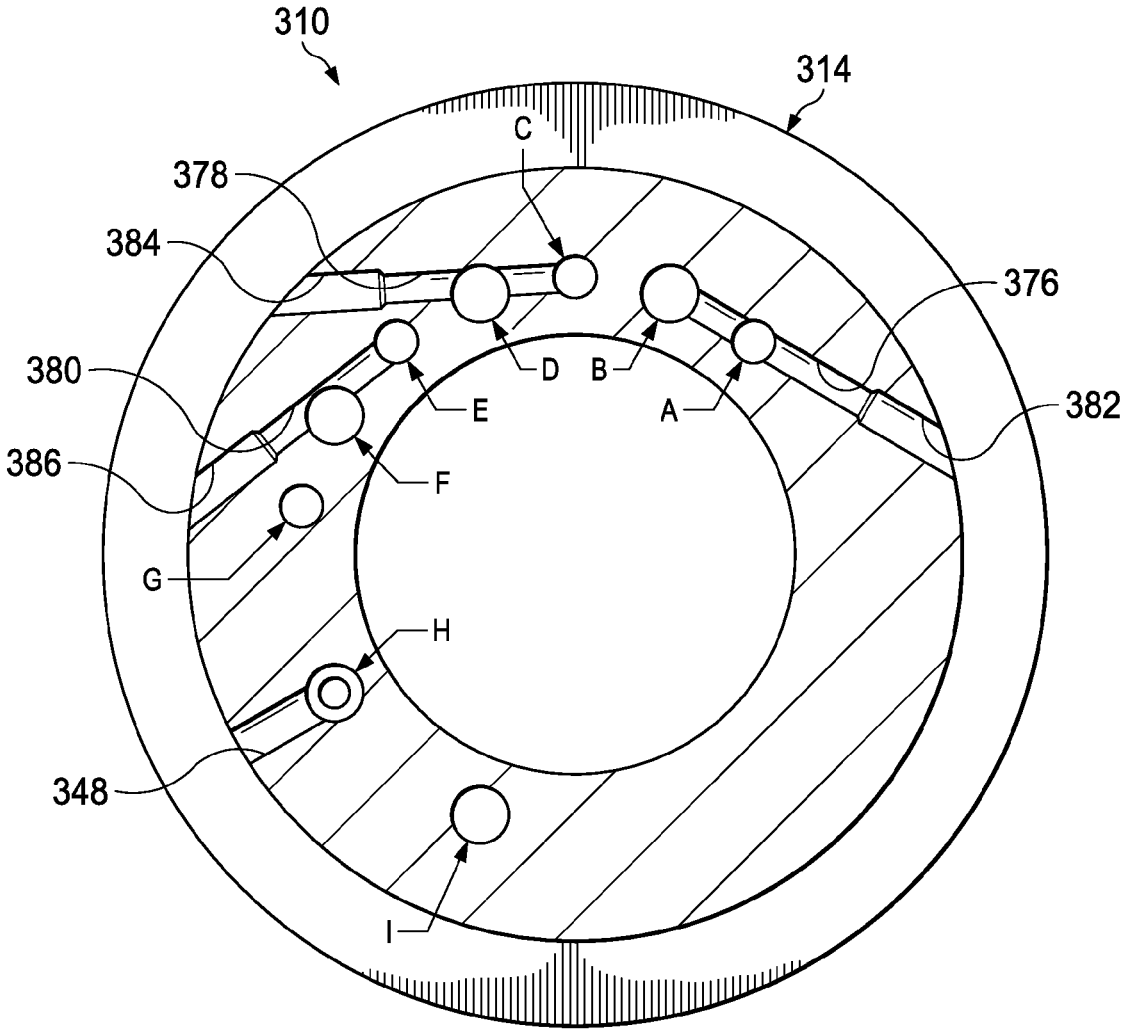
FIG. 10 illustrates a cross-sectional view of the configurable metering cartridge of FIG. 6 taken at 10-10.

Referring more specifically to FIG. 10, a cross-section of the intersection plane 340 is illustrated. In some embodiments, lateral connectors 376, 378, 380 may be positioned in the body 314 such that a longitudinal axis associated with each lateral connector 376, 378, 380 is contained within or is parallel to the intersection plane 340. Lateral connector 376 intersects and fluidly connects passageway A and passageway B. Lateral connector 378 intersects and fluidly connects passageway C and passageway D. Lateral connector 380 intersects and fluidly connects passageway E and passageway F. Each of the lateral connectors 376, 378, 380 extends from an exterior surface of the body 314 to intersect the applicable passageways. A cap region 382, 384, 386 of each lateral connector 376, 378, 380 may be provided with threads or other attachment devices such that a lateral connector plug (not shown) may be received by each cap region 382, 384, 386. Alternatively, the lateral connector plug may be permanently installed in the cap region by welding, adhesive, or another suitable attachment method. The installation of the lateral connector plug in each lateral connector 376, 378, 380 provides sealing of the lateral connector 376, 378, 380 such that fluid traveling through the lateral connector 376, 378, 380 is directed between the applicable passageways A-F and is not permitted to leak from the metering cartridge 310.

Figure 11:
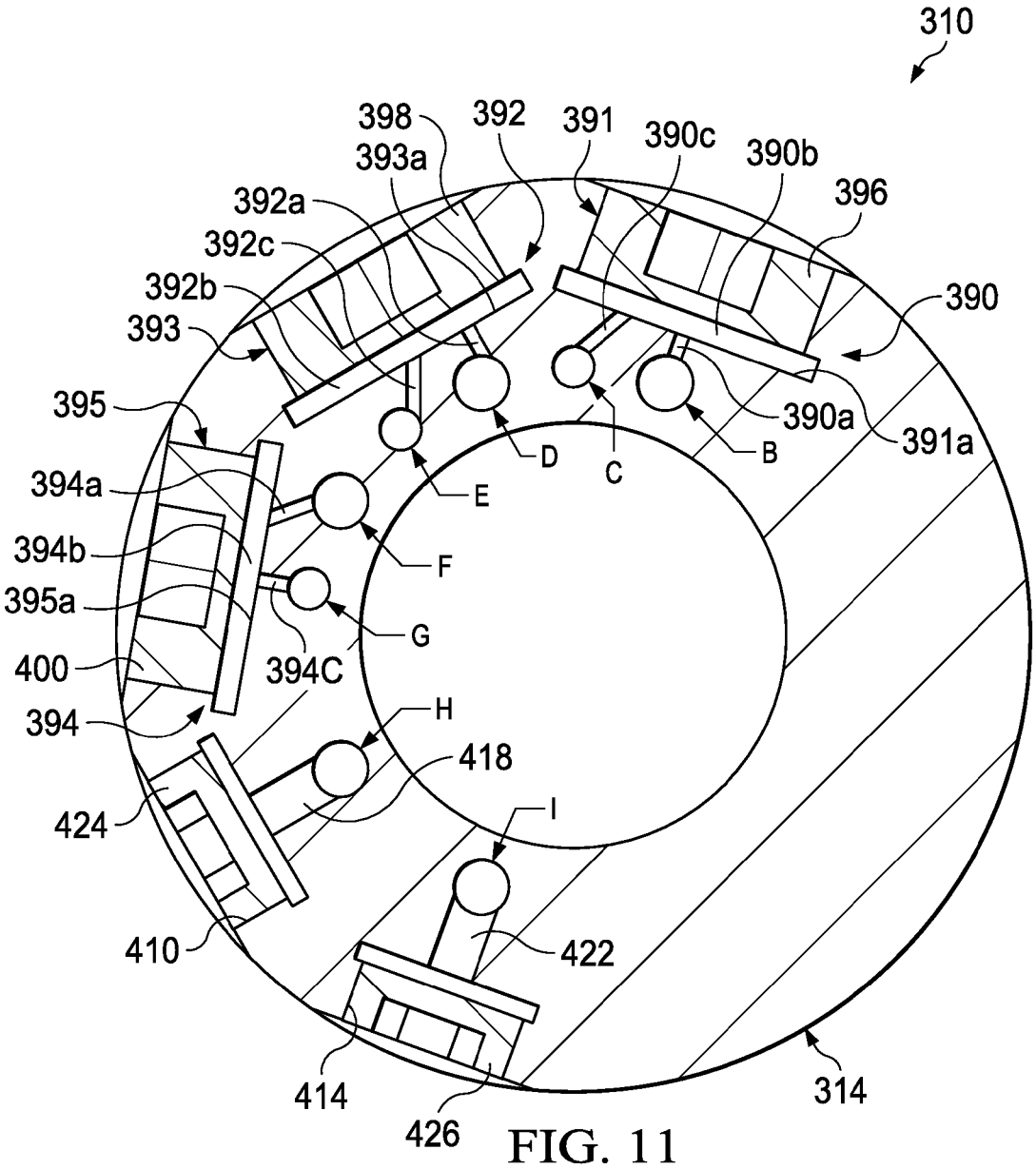
FIG. 11 illustrates a cross-sectional view of the configurable metering cartridge of FIG. 6 taken at 11-11.

Referring more specifically to FIG. 11, a cross-section of the intersection plane 352 is illustrated. In some embodiments, lateral bypass channels 390, 392, 394 may be positioned in the body 314 to provide selective fluid communication between certain of the passageways B-G. In the embodiment illustrated in FIG. 11, each lateral bypass channel 390 comprises multiple flow paths that together are capable of providing fluid communication between two of the passageways. For example, lateral bypass channel 390 includes flow paths 390*a*, 390*b*, and 390*c*. Flow paths 390*a* and 390*c* intersect passageways B and C, respectively. Flow path 390*b* is part of a recess 391 drilled or otherwise formed in the body 314 that is capable of receiving a valve 396 within the recess 391. The valve 396 may be a threaded plug that is cooperatively received by threads within the recess 391. The valve 396 is capable of restricting or allowing fluid flow through the lateral bypass channel 390 based on the positioning of the valve 396 within the recess 391. More specifically, as the valve 396 is advanced into the recess by rotating the valve 396, the valve 396 ultimately reaches a closed position in which the valve 396 contacts a terminal wall 391*a* of the recess 391. Such contact effectively blocks fluid communication between the flow path 390*a* and flow path 390*c*. The valve 396 may include a sealing ring or gasket to better prevent fluid communication between the flow paths 390*a*, 390*c* when positioned in the closed position. To place the valve 396 in an open position, the valve 396 is retracted from the recess 391 such that flow path 390*b* is exposed and fluid communication is re-established between flow paths 390*a* and 390*c*. In the open position, the valve 396 permits fluid communication between passageway B and passageway C.

Lateral bypass channel 392 includes flow paths 392*a*, 392*b*, and 392*c*. Flow paths 392*a* and 392*c* intersect passageways D and E, respectively. Flow path 392*b* is part of a recess 393 drilled or otherwise formed in the body 314 that is capable of receiving a valve 398 within the recess 393. The valve 398 may be a threaded plug that is cooperatively received by threads within the recess 393. The valve 398 is capable of restricting or allowing fluid flow through the lateral bypass channel 392 based on the positioning of the valve 398 within the recess 393. More specifically, as the valve 398 is advanced into the recess by rotating the valve 398, the valve 398 ultimately reaches a closed position in which the valve 398 contacts a terminal wall 393*a* of the recess 393. Such contact effectively blocks fluid communication between the flow path 392*a* and flow path 392*c*. Similar to valve 396, the valve 398 may include a sealing ring or gasket to better prevent fluid communication between the flow paths 392*a*, 392*c* when positioned in the closed position. To place the valve 398 in an open position, the valve 398 is rotated to retract the valve 398 from the recess 393 such that flow path 392*b* is exposed and fluid communication is re-established between flow paths 392*a* and 392*c*. In the open position, the valve 398 permits fluid communication between passageway D and passageway E.

Similar to the structure and function of lateral bypass channels 390 and 392, lateral bypass channel 394 includes flow paths 394*a*, 394*b*, and 394*c*. Flow paths 394*a* and 394*c* intersect passageways F and G, respectively. Flow path 394*b* is part of a recess 395 drilled or otherwise formed in the body 314 that is capable of receiving a valve 400 within the recess 395. The valve 400 may be a threaded plug that is cooperatively received by threads within the recess 395. The valve 400 is capable of restricting or allowing fluid flow through the lateral bypass channel 394 based on the positioning of the valve 400 within the recess 395. More specifically, as the valve 400 is advanced into the recess by rotating the valve 400, the valve 400 ultimately reaches a closed position in which the valve 400 contacts a terminal wall 395*a* of the recess 395. Such contact effectively blocks fluid communication between the flow path 394*a* and flow path 394*c*. Similar to valves 396 and 398, the valve 400 may include a sealing ring or gasket to better prevent fluid communication between the flow paths 394*a*, 394*c* when positioned in the closed position. To place the valve 400 in an open position, the valve 400 is rotated to retract the valve 400 from the recess 395 such that flow path 394*b* is exposed and fluid communication is re-established between flow paths 394*a* and 394*c*. In the open position, the valve 400 permits fluid communication between passageway F and passageway G.

While the valves 396, 398, 400 illustrated in FIG. 11 have been described as threaded plugs that may advance or retract in the applicable recesses to block or unblock the lateral bypass channels, the valves may instead be traditional valves. In such an embodiment, the valves may include inlets and outlets that are fluidly connected to the lateral bypass channels and internal valve components that are selectively positionable to allow or prevent fluid communication through the valves.

Referring still to FIG. 11, recesses 410, 414 are positioned in the body 314, and connector channels 418, 422 fluidly connect the recesses 410, 414 to passageways H, I, respectively. Similar to the recesses previously described, recesses 410, 414 may be threaded to receive a plug 424, 426 for preventing leakage from passageways H, I. The plugs 424, 426 may be removable from the recesses 410, 414 to allow access to the passageway H, I for filling or draining operations associated with the metering cartridge 310 and its use in an operational device.

Referring again to FIG. 5, a restrictor device 510 is positioned within passageway B between the intersection plane 344 and the intersection plane 340. The restrictor device 510 may be any device that is capable of reducing or restricting fluid flow or creating a pressure drop across the restrictor device 510. In some embodiments, the restrictor device may be a Visco Jet™ manufactured by The Lee Company™ of Westbrook, Conn. The Visco Jet™ uses a multiple orifice concept to induce a pressure drop across the Visco Jet™. The resistance to flow is measured in liquid ohms, or "Lohm". As an alternative to the Visco Jet™ the restrictor device 510 may instead include another multiple orifice restrictor, a single orifice restrictor, a pressure relief valve, a pressure regulator, or any other device that is capable of regulating the flow or pressure drop of a fluid.

Referring to FIG. 7, a restrictor device 710 is positioned within passageway A between the first intersection plane 344 and the intermediate intersection plane 340. Restrictor devices 714, 718 (schematically illustrated in FIG. 12) may also be positioned within each of passageway D and passageway F between the first intersection plane 344 and the intermediate intersection plane 340. Again, the restrictor device may be any device that is capable of reducing or restricting fluid flow or creating a pressure drop across the restrictor device. In some embodiments, the restrictor device may be a Visco Jet™ or may instead include another multiple orifice restrictor, a single orifice restrictor, a pressure relief valve, a pressure regulator, or any other device that is capable of regulating the flow or pressure drop of a fluid.

The restriction value or amount of restriction associated with each restrictor device (Lohms in the case of Visco Jets™) may be the same as or different than other restrictor devices within the same metering cartridge. By varying the amount of restriction across different restrictor devices, more flexibility is provided in the overall availability of restriction across the metering cartridge. In some embodiments, it may be desired to provide restrictor devices having restriction values in stepped increments, however, this configuration is not required.

Figure 12:
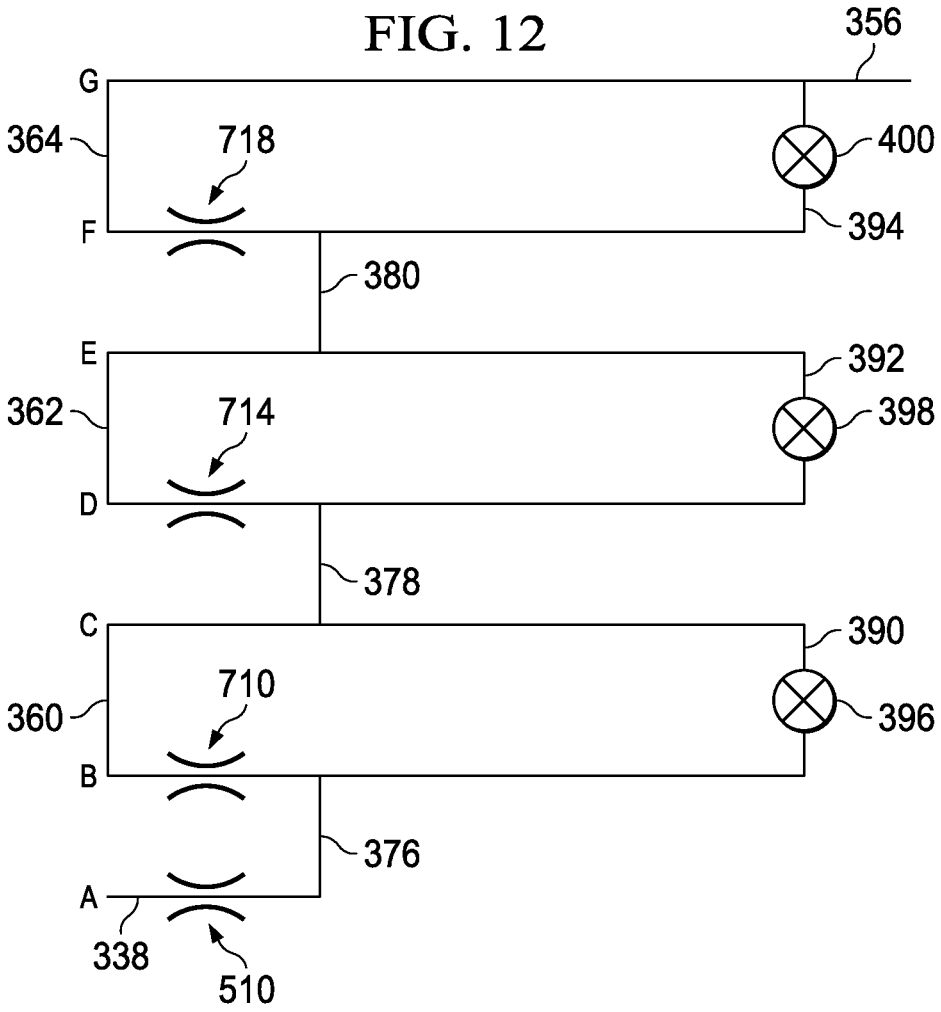
FIG. 12 illustrates a schematic depiction of the fluid communication paths, restrictors, and valves of the configurable metering cartridge of FIGS. 3-11.

Referring now to FIG. 12, a schematic depiction of the fluid communication paths, restrictors, and valves of the configurable metering cartridge 310 of FIGS. 3-11 is illustrated. While the fill and drain passageways H and I are omitted from the schematic, passageways A-G are illustrated, along with the various lateral main channels 360, 362, 364, lateral bypass channels 390, 392, 394, and lateral connectors 376, 378, 380 that fluidly connect the applicable passageways. Restrictor devices 510, 710, 714, 718 are illustrated in each of the passageways A, B, D, F, and valves 396, 398, 400 are positioned in each of the lateral bypass channels 390, 392, 394.

In operation, fluid may travel through the passageways A-G of the metering cartridge 310 in either direction. More specifically, fluid may enter the metering cartridge 310 through the inlet 338 and exit the outlet 356, or alternatively, fluid may enter the metering cartridge 310 through the outlet 356 and exit the inlet 338. For the purpose of the following operational discussion, fluid flow through the metering device will be described as traveling from the inlet 338 to the outlet 356, but it should be understand that fluid flow may be reversed as long the restrictor devices are capable of metering flow or pressure drop in both directions.

Fluid entering the inlet 338 of the metering cartridge 310 is required to pass through restrictor device 510 in passageway A without the opportunity to bypass the restrictor device 510. It is possible that in some embodiments, however, a restrictor device may not be included in passageway A. For embodiments that include the restrictor device 510 in passageway A, the restrictor device 510 meters the flow rate or pressure drop of the fluid as it passes through the restrictor device. The fluid then flows through lateral connector 376 and enters passageway B. The direction of travel in passageway B depends on the positioning of valve 396. If the valve 396 is in the open position, fluid will bypass restrictor device 710 and will travel through lateral bypass channel 390. If the valve is in the closed position, fluid will travel through restrictor device 710 and into lateral main channel 360. In either scenario, fluid entering passageway C will travel through lateral connector 378 and into passageway D. The direction of travel in passageway D again depends on the positioning of the valve 398. If the valve 398 is in the open position, fluid will bypass restrictor device 714 and will travel through lateral bypass channel 392. If the valve 398 is in the closed position, fluid will travel through restrictor device 714 and into lateral main channel 362. In either scenario, fluid entering passageway E will travel through lateral connector 380 and into passageway F. The direction of travel in passageway F depends on the positioning of the valve 400. If the valve 400 is in the open position, fluid will bypass restrictor device 718 and will travel through lateral bypass channel 394. If the valve 400 is in the closed position, fluid will travel through restrictor device 718 and into lateral main channel 364. In either scenario, fluid entering passageway G will travel out the outlet 356.

The ability to selectively route fluid through one or more restrictors provides great flexibility for users of the metering cartridge 310. As is illustrated in FIG. 12, positioning of the valves in either the open or the closed position provides a great number of configuration options, especially when restrictor devices having different restrictive properties are used. The metering cartridge may be configured prior to deployment by installing a desired number of restrictor devices, each having the desired amount of restriction, and then the metering cartridge may be further configured by opening or closing valves to route fluid through or around certain restrictors. Table 1 illustrates the various configurations available for metering cartridges having one, two, three, or four valves. Since the configuration of the metering cartridges are based on the opening or closing of the valves, each valve in the table is represented as being closed by an "X", or open by an "O". The number of configurations available for a metering cartridge having n number of valves is $2^n$ if each valve has two positions. For example, for a metering cartridge having four valves, the metering cartridge has sixteen possible configurations without changing any of the restrictors.

TABLE 1

| Configurations of Metering Cartridge | | | | | | | | | | | | | | | | |
|---|---|---|---|---|---|---|---|---|---|---|---|---|---|---|---|---|
| | Configuration | | | | | | | | | | | | | | | |
| | 1 | 2 | 3 | 4 | 5 | 6 | 7 | 8 | 9 | 10 | 11 | 12 | 13 | 14 | 15 | 16 |
| 1 valve = $2^1$ | | | | | | | | | | | | | | | | |
| Valve1 | O | X | | | | | | | | | | | | | | |
| 2 valves = $2^2$ | | | | | | | | | | | | | | | | |
| Valve1 | O | O | X | X | | | | | | | | | | | | |
| Valve2 | O | X | O | X | | | | | | | | | | | | |
| 3 valves = $2^3$ | | | | | | | | | | | | | | | | |
| Valve1 | O | O | O | O | X | X | X | X | | | | | | | | |
| Valve2 | O | O | X | X | O | O | X | X | | | | | | | | |
| Valve3 | O | X | O | X | O | X | O | X | | | | | | | | |
| 4 valves = $2^4$ | | | | | | | | | | | | | | | | |
| Valve1 | O | O | O | O | O | O | O | O | X | X | X | X | X | X | X | X |
| Valve2 | O | O | O | O | X | X | X | X | O | O | O | O | X | X | X | X |
| Valve3 | O | O | X | X | O | O | X | X | O | O | X | X | O | O | X | X |
| Valve4 | O | X | O | X | O | X | O | X | O | X | O | X | O | X | O | X |

X = closed
O = open

The number of restrictor devices in a particular metering cartridge may correspond to the number of valves. However, in some embodiments the number of restrictors may be at least n+1 if n number of valves is present. Such an embodiment would resemble the configuration of FIG. 12 which includes restrictor device 510 that is not capable of being bypassed.

While the metering cartridges and associated flow metering and restricting methods described herein have been described as being used in a tester valve, the metering cartridges may be deployed in any downhole or surface device or application where it is desired to meter or restrict fluid flow. The configurability of the described systems and methods allows quick and simple adjustability of a particular metering cartridge to match the expected environmental conditions expected to be encountered by the metering cartridge.

It should be apparent from the foregoing that an invention having significant advantages has been provided. While the invention is shown in only a few of its forms, it is not limited to only these embodiments but is susceptible to various changes and modifications without departing from the spirit thereof.

We claim:

1. A configurable metering cartridge comprising: a body having an inlet and an outlet; a plurality of passageways disposed in the body between the inlet and the outlet, the plurality of passageways arranged such that a continuous path of fluid communication is provided between the inlet and the outlet; a restrictor positioned in a first of the plurality of passageways; a valve positioned in fluid communication with the first of the plurality of passageways and a second of the plurality of passageways, the valve selectively positionable in at least two positions, the valve in a first of the positions requiring fluid flowing from the first passageway to the second passageway to pass through the restrictor, the valve in a second of the positions allowing fluid flowing from the first passageway to the second passageway to bypass the restrictor; wherein fluid is delivered to the second passageway regardless of the positioning of the valve; wherein a fluid bypassing the restrictor is required to flow through an additional restrictor or an additional valve downstream of the second passageway prior to passing through the outlet.

2. The metering cartridge of claim 1, further comprising an inlet restrictor positioned adjacent the inlet and through which fluid entering the inlet flows regardless of the positioning of the valve.

3. The metering cartridge of claim 1, wherein the first position of the valve is closed and the second position of the valve is open.

4. The metering cartridge of claim 1 further comprising:

n number of additional valves fluidly coupled between the second passageway and the outlet; and n number of additional restrictors fluidly coupled between the second passageway and the outlet;

wherein each of the additional valves is associated with a different one of the additional restrictors such that the selective positioning of the additional valve either allows or prevents flow through the different one of the additional restrictors.

5. The metering cartridge of claim 4, wherein:

the overall configuration of the metering cartridge is determined by the positioning of the valve and each of the additional valves, which determines which of the restrictors fluid is required to pass through between the inlet and outlet of the body.

6. The metering cartridge of claim 1, wherein: the body has an elongate shape and includes a first end and a second end;

each of the first and the second of the plurality of passageways extends into the body from at least one of the first end and the second end, and wherein the metering cartridge further comprises:

a lateral main channel disposed in the body to fluidly connect the first and the second of the plurality of passageways; and a lateral bypass channel disposed in the body to fluidly connect the first and the second of the plurality of passageways;

wherein the valve is disposed in the lateral bypass channel.

7. The metering cartridge of claim 6 further comprising:

a plug positioned in an end of each of the first and the second plurality of passageways to prevent leakage of fluid from the body.

8. The metering cartridge of claim 6 further comprising:

a plug positioned in an end of the lateral main channel and the lateral bypass channel to prevent leakage of fluid from the body.

9. The metering cartridge of claim 1 further comprising:

a second restrictor positioned in a third of the plurality of passageways;

a second valve positioned in fluid communication with the third of the plurality of passageways and a fourth of the plurality of passageways, the second valve selectively positionable in at least two positions, the second valve in a first of the positions requiring fluid flowing from a third passageway to a fourth passageway to pass through the second restrictor, the second valve in a second of the positions allowing fluid flowing from the third passageway to the fourth passageway to bypass the second restrictor.

10. The metering cartridge of claim 9, wherein:

the body has an elongate shape and includes a first end and a second end;

each of the first, the second, the third, and the fourth of the plurality of passageways extends into the body from at least one of the first end and the second end, and wherein the metering cartridge further comprises:

a first lateral main channel disposed in the body to fluidly connect the first and the second of the plurality of passageways;

a first lateral bypass channel disposed in the body to fluidly connect the first and the second of the plurality of passageways a second lateral main channel disposed in the body to fluidly connect the third and the fourth of the plurality of passageways;

a second lateral bypass channel disposed in the body to fluidly connect the third and the fourth of the plurality of passageways; and a lateral connector disposed in the body to fluidly connect the second and the third plurality of passageways;

wherein the valve is disposed in the first lateral bypass channel;

wherein the second valve is disposed in the second lateral bypass channel.

11. The metering cartridge of claim 10 further comprising:

a primary plug positioned in an end of each of the first, the second, the third, and the fourth of the plurality of passageways to prevent leakage of fluid from the body;

a lateral main plug positioned in an end of each of the first and the second lateral main channels to prevent leakage of fluid from the body; and a lateral connector plug positioned in an end of the lateral connector to prevent leakage of fluid from the body.

12. The metering cartridge of claim 1, wherein the first of the plurality of passageways comprises a first branch extending to the restrictor and a second branch extending to the valve wherein the first branch and the second branch are fluidically recombined at the second of the plurality of passageways.

* * * * *